US005697563A

United States Patent [19]

Fujimoto et al.

[11] Patent Number: 5,697,563

[45] Date of Patent: Dec. 16, 1997

[54] CHAIN BEATING TYPE CRUSHER

[75] Inventors: Shigeo Fujimoto; Michio Ito, both of Fuji, Japan

[73] Assignee: Kabushiki Kaisha Fujimoto Pollcon, Fuji, Japan

[21] Appl. No.: 793,120

[22] PCT Filed: Aug. 22, 1994

[86] PCT No.: PCT/JP94/01382

§ 371 Date: Feb. 19, 1997

§ 102(e) Date: Feb. 19, 1997

[87] PCT Pub. No.: WO96/05912

PCT Pub. Date: Feb. 29, 1996

[51] Int. Cl.[6] ..... B02C 13/16; B02C 13/26

[52] U.S. Cl. ..... 241/102; 241/162; 241/193

[58] Field of Search ..... 241/102, 162, 241/193, DIG. 38

[56] References Cited

U.S. PATENT DOCUMENTS

| | | | |
|---|---|---|---|
| 1,728,976 | 9/1929 | Nobis | 241/193 X |
| 2,525,023 | 10/1950 | Ensminger | 241/193 X |
| 2,592,481 | 4/1952 | Spencer et al. | 241/102 |
| 2,965,320 | 12/1960 | Pierson | 241/193 |
| 3,973,735 | 8/1976 | Ito et al. | 241/73 |
| 3,993,256 | 11/1976 | Brewer | 241/193 X |
| 4,214,716 | 7/1980 | Jadouin | 241/194 X |
| 4,875,630 | 10/1989 | Carlson | 241/56 |
| 5,630,556 | 5/1997 | Chrestenson | 241/79 |

FOREIGN PATENT DOCUMENTS

| | | |
|---|---|---|
| 38-837 | 2/1938 | Japan . |
| 56-238 | 1/1981 | Japan . |
| 58-8899 | 2/1983 | Japan . |
| 59-2841 | 1/1984 | Japan . |

*Primary Examiner*—John M. Husar

*Attorney, Agent, or Firm*—Wenderoth, Lind & Ponack

[57] ABSTRACT

A chain beating type crusher includes a crusher vessel (3), a shaft (7) provided centrally thereof and capable of being rotated at a high speed, and a plurality of beating chains (11) provided in a plurality of axially spaced-apart stages in each of which a plurality of radially spaced-apart chains are formed on the shaft. With high speed rotation of the shaft the beating chains in the individual stages are caused to undergo high speed revolution to form respective bearing zones. In order to return an object scattered toward the inner surface of a peripheral wall (4) of the crusher vessel back to the beating sone, a plurality of guide members (15) are mounted on the inner surface and each have a surface inclined toward the beating zones in the direction of revolution of the beating chains. The beating chains are mounted on the shaft such that they are each positioned in correspondece to the mid position between adjacent ones of them in the next stage. Each of them is coupled to an independent support bar (13) which is fitted in a recess provided in a chain holder means (14) secured to the outer periphery of the shaft. A rotary disc (16) is provided for rotation about its shaft in the lowermost portion of the crusher vessel, and a plurality of scrapers (17) are provided on the rotary disc to cause the crushed object to be led downward and pushed to the outside of the peripheral wall of the crusher vessel.

4 Claims, 3 Drawing Sheets

CHAIN BEATING TYPE CRUSHER

TECHNICAL FIELD

This invention relates to a chain beating type crusher and, more particularly, to a chain beating type crusher which belongs to the beating type crusher and which crushes an object to be processed by beating it with chains revolving at a high speed.

TECHNICAL BACKGROUND

As the crusher, a variety of mechanisms are available, but they require several steps for finely crushing a large mass as an object. Among the beating type crushers is, for instance, a hammer mill which crushes an object with a beating action of rotating blades. The hammer mill, however, has a problem in the durabiity of the blades because the blades are damaged when a hard object is processed.

As a variety of the beating type crushers for crushing an object with a beating action, chain beating type crushers have recently been used which crush an object with a beating action of chains revolving at a high speed. In such a chain beating type crusher, an object charged from above into a multistage beating zone, which has successive beating zones or stages each formed by a plurality of beating chains revolving at a high speed, is allowed to fall due to the own weight, so that it is beaten and crushed in the successive beating zones formed one below another in the falling direction. In this chain beating type crusher, the falling speed of the object and the speed of revolution of the beating chains are related such as to obtain desired crushing. Theoretically, when the time required for the object to pass through one stage of the beating zone which is formed by a plurality of beating chains revolving at a high speed is set equal to the time required for the beating chains to revolve once, the number of times of beating of the object during the passage thereof through one stage is equal to the number of the beating chains in one stage, and the object is beaten a number of times, which is the product of the number of times of beating in one beating zone stage multiplied by the number of the successive beating zone stages. Also in this chain beating type crusher, a crusher vessel thereof has a steel-made peripheral wall, which has a greater radius than the length, to which the beating chains caused to revolve at a high speed about an axis of revolution are stretched by the centrifugal force in a revolving direction perpendicular to the axis of revolution. This peripheral wall can prevent the object from being scattered by the centrifugal force to the outside of the crusher vessel.

In the prior art chain beating type crusher, however, the considerable part of the object falls along the inner surface of the peripheral wall of the crusher vessel without receiving the theoretical number of beatings by the beating chains revolving at a high speed. That is, the number of times the object is beaten is greatly reduced.

A first object of the invention is to provide a chain beating type crusher, which can overcome the above drawback and is adapted to give an object the theoretical number of times of beating actions by the beating chains revolving at a high speed, thus increasing the crushing efficiency.

A second object of the invention is to provide a chain beating type crusher for crushing an object with a beating action of beating chains revolving at a high speed which permits finer crushing of the object.

The conventional chain beating type crusher for crushing an object with a beating action of beating chains revolving at a high speed has a different problem. Portions of the beating chains that are mounted on the shaft are subject to severe wear caused in a long operation by the centrifugal forces of the beating chains and the high beating impact force of beating. In actual use of this chain beating type crusher, therefore, it is necessary to reduce the wear of the beating chain portions mounted on the shaft as much as possible.

A third object of the invention is to provide a chain beating type crusher, which can solve the above problem and in which the wear of the beating chain portions mounted on the shaft is reduced as much as possible, thus extending the service life of the beating chain portions mounted on the shaft, reducing the time of replacement and improving the durability.

The conventional chain beating type crusher for crushing an object with a beating action of beating chains revolving at a high speed, has a further problem. A light weight object which is beaten a number of times exceeding the above theoretical number, readily becomes stagnant in the beating zone formed by the beating chains revolving at a high speed, and cannot smoothly pass continuously through the successive beating zone stages formed one below another in the direction of falling of the object. Therefore, the processing capacity is greatly reduced, resulting in excessive drive power load.

A fourth object of the invention is to provide a beating type crusher, which can solve the above problem and allows even a light weight object to pass through the successive beating zone stages, which are formed one below another in the direction of falling of the object by the beating chains revolving at a high speed, continuously without becoming stagnant, thus increasing the crushing efficiency.

The invention thus seeks to provide a chain beating type crusher for crushing an object with a beating action of beating chains revolving at a high speed, which has increased crushing efficiency, improved mechanical durability and excellent usefulness.

DISCLOSURE OF THE INVENTION

The chain beating type crusher according to the invention comprises a crusher vessel having a steel-made peripheral wall having an inlet formed at the top for charging an object and an outlet formed adjacent the bottom for taking out the object having been crushed, a vertical shaft extending centrally of the crusher vessel and capable of being rotated about its axis, and a plurality of beating chains capable of beating and thereby crushing the object, the beating chains being mounted in a plurality of axially spaced-apart stages in each of which a plurality of radially uniformly spaced-apart chains are formed on the vertical shaft, the beating chains being capable, by causing high speed rotation of the vertical shaft, of revolving at a high speed and being stretched in directions perpendicular to the axial direction of the vertical shaft by the centrifugal force, thereby forming the axially spaced-apart beating zones individually defined by the respective beating chain stages. To attain the above first object, the chain beating type crusher according to the invention is characterized in that a plurality of guide members are provided on the inner surface of the peripheral wall of the crusher vessel in portions thereof corresponding to the beating zones and at circumferentially spaced-apart positions. These guide members each have an inclined surface inclined toward the center of the crusher vessel in the direction of revolution of the beating chains, and they serve to return the object, which has been scattered toward the inner surface of the peripheral wall by the centrifugal force of the revolving beating chains, from the inner surface toward the beating zones. With this construction of the chain beating type crusher, an object charged from the inlet is allowed to fall by its own weight to be beaten in the successive beating zones formed one below another in the direction of the fall by the beating chains revolving at a high speed, and is progressively crushed as it passes down through the successive beating zones. Besides, the beating chains which are revolving at a high speed and providing a beating action, can change their shape when they are given strong impact by the object. That is, they can change their shape in an escaping manner with respect to irrational collision with the object. It is thus possible to crush the object without irrationally high load applied to the revolving beating chains. Moreover, the guide members return the object, which has been scattered to the outside of the beating zones, i.e., toward the inner surface of the peripheral wall of the crusher vessel, by the centrifugal force pf the beating chains revolving at a high speed, from the inner surface noted above toward the beating zones around the vertical shaft. This has an effect of permitting the object to receive the theoretical number of times of beating action by the beating chains.

To attain the above second object, the chain beating type crusher according to the invention is characterized in that the beating chains which are arranged at a radially uniform interval, are each attached to the vertical shaft at a staggered position thereof corresponding to the midway position between adjacent ones in the next stage. With this arrangement of the chain beating type crusher, it is possible to reduce the gap between the adjacent beating chains revolving at a high speed, throuch which the object charged from the inlet passes. In other words, it is possible to increase the reliability that the process material receives the theoretical number of times of beating action while it passes through each stage beating zone.

To attain the above third object, the chain beating type crusher according to the invention is characterized in that the beating chains each have an end ring coupled to a corresponding one of separate support bars each fitted in recesses provided in a chain holder means secured to the outer perphery of the vertical shaft. With this arrangement, in which each beating chain is coupled to each separate support bar, which is fitted in recesses provided in the chain holder means, the degree of freedom of movement of the support bar is increased to prevent partial wear thereof on one side and reduce wear of a portion of the bearing chain mounted on the vertical shaft as much as possible.

To attain the above fourth object, the chain beating type crusher according to the invention is characterized in that it further comprises a rotary disc mounted on the vertical shaft for rotation about the axis in the lowermost portion of the crusher vessel, and a scraper means provided on the top of the rotary disc to cause the crushed object to be led downward and be pushed out of the peripheral wall through the outlet. With the provision of the scraper means to cause the crushed object to be led downward and be pushed out to the outside of the peripheral wall, even a light weight object can pass through the successive beating zones, which are formed one below another in the direction of its fall by the beating chains revolving at a high speed, continuously and without becoming accumulated in these beating zones.

BEST MODE FOR WORKING THE INVENTION

Figure 1:
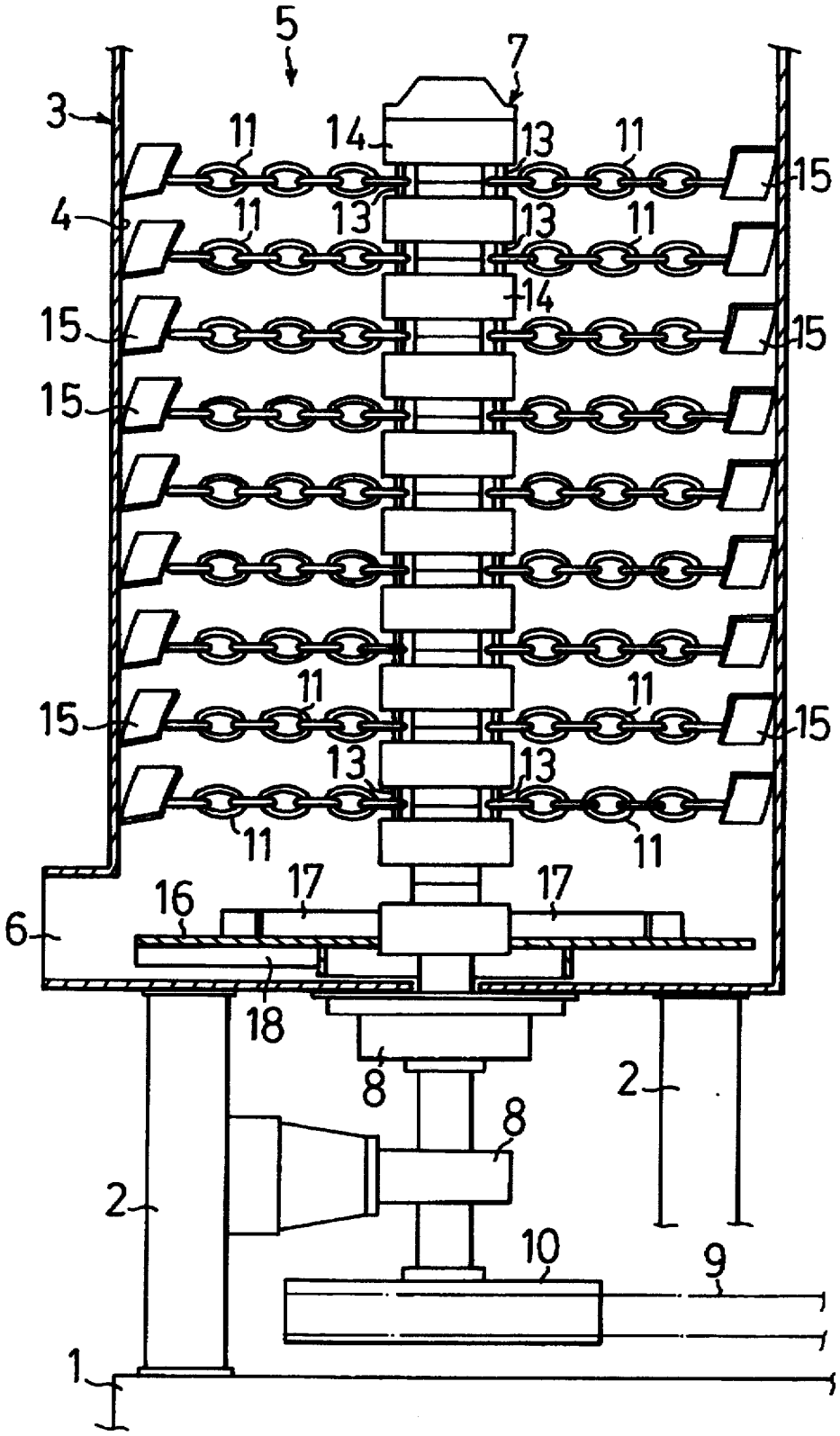
FIG. 1 is an elevational sectional view showing a chain beating type crusher of the invention as a whole.

An embodiment of the invention will now be described with reference to the drawings. Referring to FIG. 1, a crusher vessel 3 is secured to a base 1 via legs 2. The crusher vessel 3 comprises a cylindrical peripheral wall 4 made from a steel plate and has an inlet 5 formed at the top for charging an object to be crushed and an outlet 6 provided adjacent the bottom for taking out the crushed material. Centrally of the crusher vessel 3, a vertical shaft 7 which is rotated about its axis at a high speed is supported in bearings 8. The shaft 7 is driven from a drive motor (not shown) via a drive belt 9, which is passed round a drive pulley 10 mounted on the lower end of the shaft 7 projecting downward from the crusher vessel 3. Beating chains 11 in the form of ring chains are hung in a multiplicity of axially spaced-apart stages from the shaft 7. These beating chain stages each comprise a plurality of radially uniformly spaced-apart beating chains 11. When the crusher is not operated the beating chains 11 depend from the shaft 7. By causing high speed rotation of the shaft 7, the revolving beating chains 11 are spread by the centrifugal force into the horizontal state perpendicular to the axial direction of the shaft 7 as shown in FIG. 1. In this state, the beating chains 11 in the individual stages define respective beating zones corresponding in thickness to the thickness of the beating chains 11.

Figure 2:
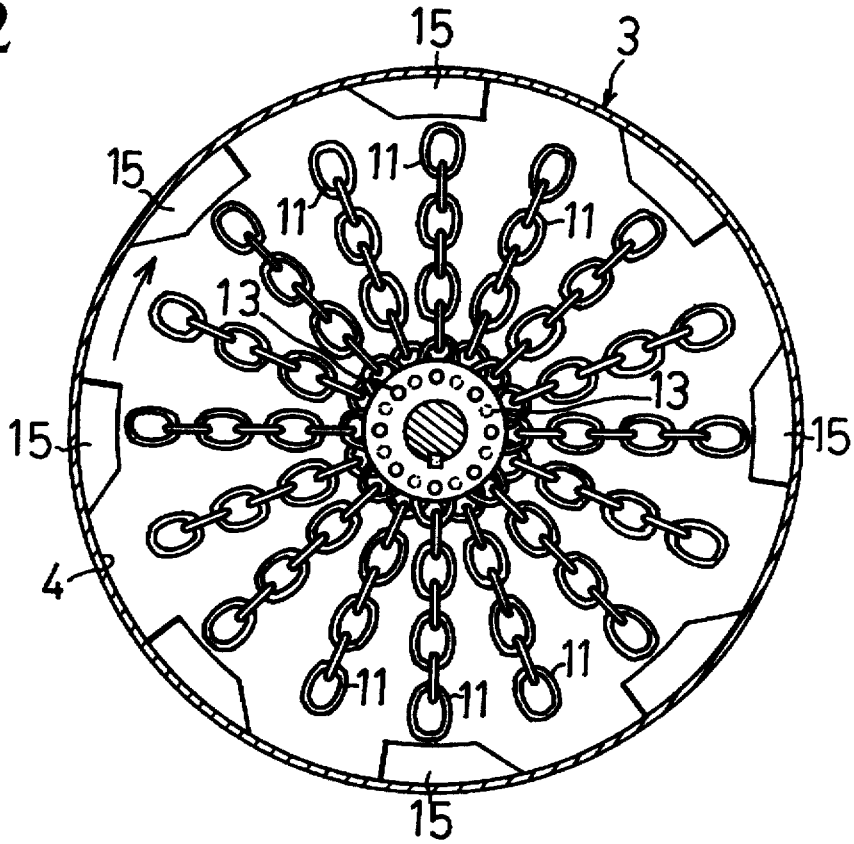
FIG. 2 is a transversal sectional view showing the manner of mounting of beating chains.

The beating chains 11 are attached at a radially uniform interval in each stage to the shaft 7 in a staggered manner between adjacent stages. As shown in FIG. 2, specifically each beating chain 11 is attached at a position corresponding to the midway position between adjacent beating chains 11 in the next stage.

Figure 3:
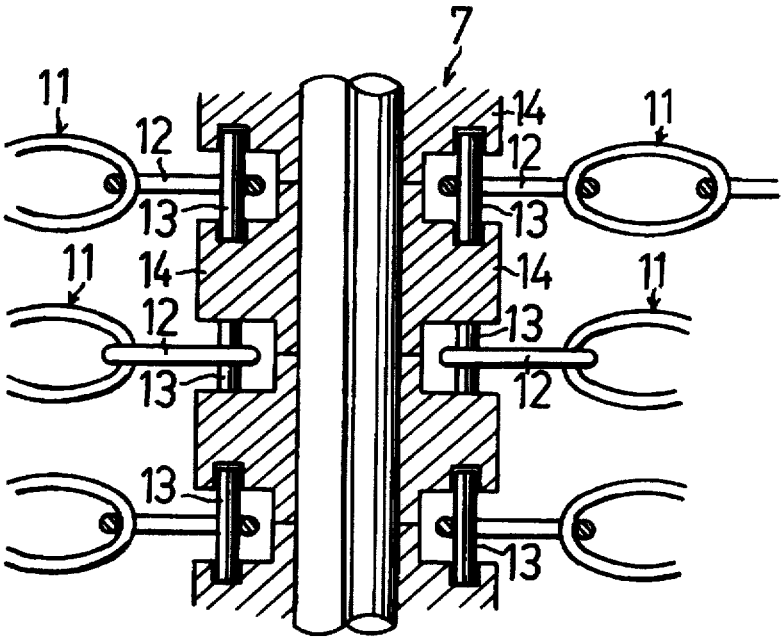
FIG. 3 is a fragmentary enlarged-scale elevational sectioonal view showing mounting portions of the beating chains.

FIG. 3 illustrates the manner in which the beating chains 11 are attached to the shaft 7. As shown, support bars 13 are each fitted for each beating chain 11, with a sliding gap provided, in a chain holder means 14 secured to the outer periphery of the shaft 7, and an end ring 12 of each beating chain 11 is coupled to each support bar 13.

The steel-made cylindrical peripheral wall 4 of the crusher vessel 3 has a circular or polygonal sectional profile having a greater radius than the length, to which the bearing chains 11 revolving about the shaft 7 are stretched by the centrifugal force in the direction normal to the axial direction of the shaft 7, and prevents the object from being scattered by the centrifugal force exerted by the beating chains 11. In order for the object, which is scattered toward the inner surface of the peripheral wall 4 by the centrifugal force of the revolving beating chains 11, to be returned from the above inner surface toward the beating zones defined centrally of the crusher vessel 3 by the revolving beating chains 11, a plurality of guide members 15 having a surface inclined toward the center of the crusher vessel 3 in the direction of revolving of the bearing chains 11, are provided on the inner surface of the peripheral wall 4 in portions thereof corresponding to the individual axially spaced-apart beating zones and at circumferentially spaced-apart positions.

Figure 4:
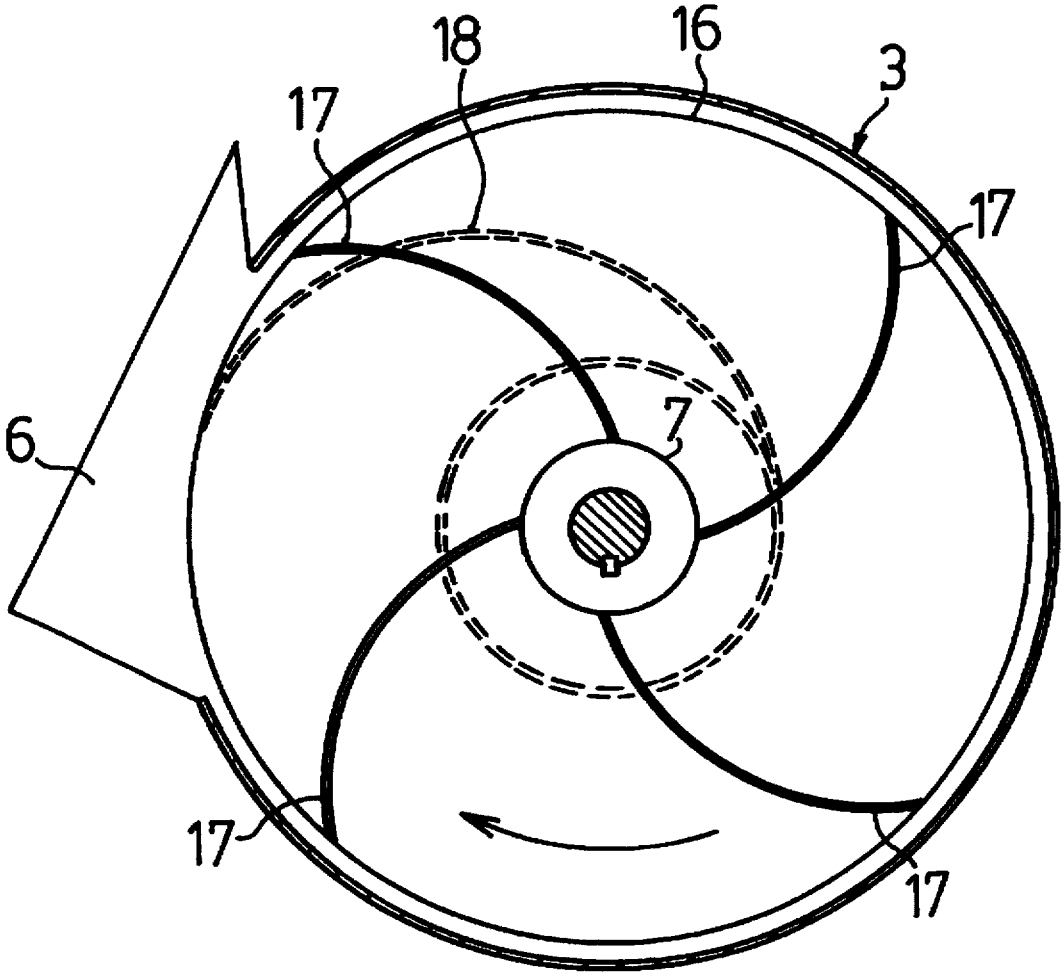
FIG. 4 is a transversal sectional view showing a rotary disc and a plurality of scrapers provided thereon.

As shown in FIGS. 1 and 4, in the lowermost portion of the crusher vessel 3 a rotary disc 16 is mounted on the shaft 7 for rotation about the same. The rotary disc 16 has a plurality of scrapers 17 provided on its top to cause the crushed object to be led downward and be pushed out of the peripheral wall 4 through the outlet 6. The rotary disc 16 also has a scraper 18 provided on its underside for pushing the scraped object having fallen off it toward the outlet 6.

INDUSTRIAL APPLICABILITY OF THE INVENTION

The chain beating type crusher according to the invention having the construction as described in the foregoing has the following beneficial effects.

The object charged from the inlet and allowed to fall down by its own weight is beaten and crushed by the plurality of beating chains revolving at a high speed in the successive beating zones formed one below another in the direction of the fall. Since the charged object is progressively crushed by the beating action as it falls through the successive beating zones from the uppermost one, even a large mass can be finely crushed in a single crushing process. Also, finer crushing is attainable as desired by passing the object through the crusher twice, three times and so forth.

While the object is progressively crushed as it passes through the successive beating zones, the beating chains which provide the beating action with their high speed revolution, can change their shape when they are given strong impact by the object. That is, they can change their shape in an escaping manner when they irrationally collide with the object. Thus, they can crush the object without possibility of application of irrationally high load to them in their state of high speed revolution. In other words, they can crush even a hard object without possibility of their damage, and their durability can be improved.

The plurality of guide members are provided on the inner surface of the peripheral wall of the crusher vessel in portions thereof corresponding to the beating zones, which are formed by the revolving beating chains, at circumferentially spaced-apart positions, and they each have a surface inclined toward the center of the crusher vessel in the direction of revolving of the beating chains. Thus, when the object is scattered the inner surface of the peripheral wall of the crusher vessel, it can be returned from the peripheral wall inner surface toward the beating zones around the shaft, so that it can receive the theoretical number of times of beating actions by the beating chains. The crushing efficiency thus can be greatly increased.

As described above, the object charged from the inlet of the chain beating type crusher is progressively crushed as it falls through the successive beating zone stages from the uppermost one. With beating chains in each beating zone stage mounted on the shaft in staggered positions each corresponding to the midway position between adjacent beating chains in the next beating zone stage, it is possible to reduce the gap between the adjacent beating chains revolving at a high speed, through which the object passes , thus increasing the possibility that the object receives the theoretical number of times of beating actions while the object passes through each beating zone stage. Finer crushing of the object is thus possible.

As described above, each beating chain has an end ring coupled to a corresponding one of separate support bars each fitted in a recess provided in the chain holder means secured to the outer periphery of the shaft. With this arrangement, the degree of freedom of movement of the support bar is increased to prevent partial wear thereof on one side and reduce wear of a portion of the beating chain mounted on the vertical shaft as much as possible. The durability of the potion of the beating chain mounted on the shaft is thus increased so that it is not necessary to replace the support bar frequently, thus permitting long continuous operation and increasing the processing capacity.

Moreover, with the provision of the scraper means to cause the crushed object to be led downward and pushed to the outside of the peripheral wall, even a light weight object can pass through the successive heating zones which are formed, one below another in the direction of its fall by the beating chains revolution at a high speed continuously and without becoming accumulated in these beating zones. A high crushing efficiency thus can be maintained even with a light weight object.

What is claimed is:

1. A chain beating type crusher comprising a crusher vessel (3) having a steel-made peripheral wall (4) having an inlet (5) formed at the top for charging an object and an outlet (6) formed adjacent the bottom for taking out the object having been crushed, a vertical shaft (7) extending centrally of said crusher vessel and capable of being rotated about its axis, a plurality of beating chains (11) capable of beating and thereby crushing said object, said beating chains being mounted in a plurality of axially spaced-apart stages in each of which a plurality of radially uniformly spaced-apart chains are formed on said vertical shaft (7), said beating chains being capable, by causing high speed rotation of said vertical shaft, of revolving at a high speed and being stretched in directions perpendicular to the axial direction of said vertical shaft by the centrifugal force, thereby forming axially spaced-apart beating zones individually defined by said respective beating chain stages, and a plurality of guide members (15) provided on the inner surface of said peripheral wall (4) of said crusher vessel in portions thereof corresponding to said beating zones and at circumferentially spaced-apart positions, said guide members each having a surface inclined toward the center of said crusher vessel in the direction of revolution of said beating chains for said object having been scattered toward said inner surface of said peripheral wall by the centrifugal force exerted by said revolving bearing chains to be returned from said inner surface toward said beating zones.

2. The chain beating type crusher according to claim 1, wherein said beating chains (11) in the radially uniform interval arrangement are each attached to said vertical shaft at a staggered position thereof corresponding to the midway position between adjacent beating chains in the next stage.

3. The chain beating type crusher according to claim 1, wherein said beating chains each have an end ring (12) coupled to a corresponding one of support bars (13) each fitted in a recess provided in a chain holder means (14) secured to the outer periphery of said vertical shaft.

4. The chain beating type crusher according to claim 1, which further comprises a rotary disc (16) mounted on said vertical shaft for rotation about the axis in the lowermost portion of said crusher vessel, and a scraper means (17) provided on the top of said rotary disc to cause the crushed object to be led downward and pushed out of said peripheral wall through said outlet.

* * * * *